US007766337B2

(12) United States Patent
Constantine et al.

(10) Patent No.: US 7,766,337 B2
(45) Date of Patent: Aug. 3, 2010

(54) GAME APPARATUS

(75) Inventors: David James Constantine, Orland Park, IL (US); Daniel Richard Constantine, Orland Park, IL (US); Carrie Ann Constantine, Champaign, IL (US)

(73) Assignee: Soarex, Inc., Orland Park, IL (US)

( * ) Notice: Subject to any disclaimer, the term of this patent is extended or adjusted under 35 U.S.C. 154(b) by 175 days.

(21) Appl. No.: 12/194,307

(22) Filed: Aug. 19, 2008

(65) Prior Publication Data

US 2010/0044964 A1 Feb. 25, 2010

(51) Int. Cl.
*A63F 7/00* (2006.01)

(52) U.S. Cl. ..... 273/317.6; 273/317; 273/317.1; 273/348

(58) Field of Classification Search ..... 273/317, 273/317.1, 317.6, 348, 353, 398–402
See application file for complete search history.

(56) References Cited

U.S. PATENT DOCUMENTS

| | | | | | |
|---|---|---|---|---|---|
| 817,928 | A | * | 4/1906 | Medley | 124/7 |
| 867,935 | A | * | 10/1907 | Parker | 273/386 |
| 1,072,954 | A | * | 9/1913 | Junn | 273/394 |
| 1,502,619 | A | | 7/1924 | Doob | |
| 1,996,986 | A | * | 4/1935 | Weinberg | 273/400 |
| 2,520,460 | A | * | 8/1950 | Ford | 124/7 |
| 2,596,439 | A | | 5/1952 | Rose | |
| 2,799,502 | A | * | 7/1957 | Isakson | 273/399 |
| 3,051,488 | A | * | 8/1962 | Villa | 273/390 |
| 3,351,344 | A | * | 11/1967 | Dupuy | 273/400 |
| 3,576,325 | A | | 4/1971 | Naturale | |
| 3,705,723 | A | | 12/1972 | Eissler | |
| 3,706,454 | A | | 12/1972 | Parlato | |
| 3,734,501 | A | | 5/1973 | La Monica | |
| 3,764,139 | A | | 10/1973 | Cohen | |
| 3,814,425 | A | | 6/1974 | Kanefield et al. | |
| 3,913,915 | A | | 10/1975 | Carmen | |
| 3,941,381 | A | | 3/1976 | Trbovich | |
| 3,957,269 | A | | 5/1976 | Bouchard | |
| 3,972,530 | A | | 8/1976 | Dohn | |
| 4,010,957 | A | | 3/1977 | Tricoli | |
| 4,017,074 | A | | 4/1977 | Roberts | |
| 4,030,760 | A | | 6/1977 | Danowski | |
| 4,116,442 | A | | 9/1978 | Dickey | |
| 4,141,560 | A | | 2/1979 | Kaslow | |
| 4,179,123 | A | | 12/1979 | Tsukuda | |

(Continued)

OTHER PUBLICATIONS

The Webtender, Bartender's Handbook, Apr. 28, 2008, 1 page, http://www.webtender.com/handbook/games/baseball.game.

(Continued)

*Primary Examiner*—Raleigh W. Chiu
(74) *Attorney, Agent, or Firm*—Beem Patent Law Firm

(57) ABSTRACT

A game playing apparatus is provided. The apparatus is configured to facilitate playing a game. The apparatus includes a body including at least one first column including at least one receptacle and a second column coupled to the at least one first column. The second column has an upper surface having a plurality of openings such that a member may be tossed into at least one of the openings. The apparatus also includes a game surface coupled to the body, and a backboard coupled substantially perpendicular to the game surface.

17 Claims, 5 Drawing Sheets

U.S. PATENT DOCUMENTS

| | | | | | |
|---|---|---|---|---|---|
| 4,216,961 | A | | 8/1980 | McQuillan | |
| 4,230,316 | A | | 10/1980 | Harper | |
| 4,261,569 | A | | 4/1981 | Frohlich | |
| 4,323,250 | A | * | 4/1982 | Lansberry | 273/400 |
| 4,327,913 | A | | 5/1982 | Bock | |
| 4,438,927 | A | | 3/1984 | Hefler | |
| 4,452,453 | A | | 6/1984 | Daley et al. | |
| 4,519,610 | A | | 5/1985 | Kallio | |
| 4,602,786 | A | | 7/1986 | Valentino | |
| 4,653,755 | A | | 3/1987 | Panella et al. | |
| 4,687,199 | A | | 8/1987 | Aguirregomezcorta | |
| 4,708,344 | A | | 11/1987 | Wyatt | |
| 4,715,603 | A | | 12/1987 | Gleason | |
| 4,877,256 | A | * | 10/1989 | Falloon | 273/400 |
| 4,921,251 | A | | 5/1990 | Kanenwisher | |
| D322,291 | S | | 12/1991 | Szathmary et al. | |
| 5,125,658 | A | | 6/1992 | Francis et al. | |
| 5,129,651 | A | | 7/1992 | Tobias, Jr. | |
| 5,183,266 | A | | 2/1993 | Kohler | |
| 5,201,520 | A | | 4/1993 | Castle et al. | |
| D340,746 | S | | 10/1993 | Breen et al. | |
| 5,280,912 | A | | 1/1994 | Porter | |
| 5,320,360 | A | * | 6/1994 | St. Pierre | 273/402 |
| 5,333,879 | A | * | 8/1994 | Barnes | 273/400 |
| 5,390,933 | A | | 2/1995 | Kraus | |
| 5,407,204 | A | | 4/1995 | Meyer, III | |
| 5,409,221 | A | | 4/1995 | Cohn | |
| 5,423,552 | A | | 6/1995 | English | |
| 5,435,567 | A | | 7/1995 | Compres | |
| 5,516,114 | A | * | 5/1996 | Michlin et al. | 273/400 |
| 5,540,440 | A | | 7/1996 | Liu | |
| 5,582,409 | A | | 12/1996 | Mayorga et al. | |
| 5,664,780 | A | | 9/1997 | Bricker | |
| 5,681,042 | A | | 10/1997 | D'Aurora et al. | |
| 5,704,612 | A | * | 1/1998 | Kelly et al. | 273/402 |
| 5,732,952 | A | * | 3/1998 | Joseph | 273/317.6 |
| 5,884,914 | A | | 3/1999 | Lilien | |
| 6,032,954 | A | | 3/2000 | Fotter | |
| 6,113,096 | A | | 9/2000 | Simmons | |
| 6,315,293 | B1 | | 11/2001 | Bush | |
| 6,419,227 | B1 | | 7/2002 | Barnhardt | |
| 6,419,230 | B1 | | 7/2002 | Cass | |
| 6,530,571 | B1 | | 3/2003 | McWilliams | |
| 6,605,011 | B1 | | 8/2003 | Yamamoto et al. | |
| 6,641,136 | B2 | | 11/2003 | Huang | |
| 6,666,455 | B1 | | 12/2003 | Dow | |
| 6,805,348 | B1 | | 10/2004 | Chen | |
| 6,983,936 | B1 | | 1/2006 | Clapper | |
| 7,325,807 | B1 | * | 2/2008 | Eason | 273/342 |
| 7,354,040 | B2 | | 4/2008 | Schneider | |
| 7,611,146 | B2 | * | 11/2009 | Arden | 273/317 |
| 2003/0224866 | A1 | * | 12/2003 | Chen | 473/197 |
| 2003/0228924 | A1 | * | 12/2003 | Isom | 473/197 |
| 2005/0029747 | A1 | | 2/2005 | Grayson | |
| 2005/0077676 | A1 | | 4/2005 | Long et al. | |
| 2005/0116413 | A1 | | 6/2005 | Wagner | |
| 2006/0065665 | A1 | | 3/2006 | Swartfager et al. | |
| 2006/0226606 | A1 | | 10/2006 | Finley et al. | |
| 2007/0107460 | A1 | | 5/2007 | Webb et al. | |
| 2007/0284824 | A1 | * | 12/2007 | Arden | 273/317 |
| 2008/0211189 | A1 | * | 9/2008 | Williams et al. | 273/348 |

OTHER PUBLICATIONS

Barmeister, Online Guide to Drinking, Apr. 28, 2008, 2 pages, http://www.barmeister.com/games/rules/31/.

EHOW, How to Play the Baseball Drinking Game, Apr. 28, 2008, 2 pages, http://www.ehow.com/how_2107249_play-baseball-drinking-game.html.

WWW.BREWTHIS.COM, Baseball Drinking Game Rules, Apr. 28, 2008, 1 page, http://www.brewthis.com/drinking-games/Baseball.html.

* cited by examiner

GAME APPARATUS

BACKGROUND OF THE INVENTION

1. Field of the Invention

The present invention is directed to a game apparatus, particularly to an apparatus to facilitate playing a baseball-themed game.

2. Description of the Related Art

Games generally are created when a person comes up with an idea for a game and makes the game board and/or apparatus out of easily accessible resources such as household products. Constantly using household products may be time consuming, inefficient and wasteful.

A known household game includes a plurality of plastic cups and a coin. The player tosses the coin towards the cups and points are scored when the coin lands in one of the cups. This game apparatus is inefficient as the cups are often knocked over while the game is being played and the coin frequently falls between the cups rather than in one of the cups.

What is needed is a game apparatus for a game that is played by tossing a coin towards receptacles that overcomes shortcomings of prior art games and can be used repeatedly.

BRIEF SUMMARY OF THE INVENTION

In one aspect of the invention, a game playing apparatus is provided. The apparatus is configured to facilitate playing a game. The apparatus includes a body including at least one first column including at least one receptacle and a second column coupled to the at least one first column. The second column has an upper surface having a plurality of openings such that a member may be tossed into at least one of the openings. The apparatus also includes a game surface coupled to the body, and a backboard coupled substantially perpendicular to the game surface.

These and other features and advantages are evident from the following description of the present invention, with reference to the accompanying drawings.

DETAILED DESCRIPTION OF THE ILLUSTRATED EMBODIMENTS

Figure 1:
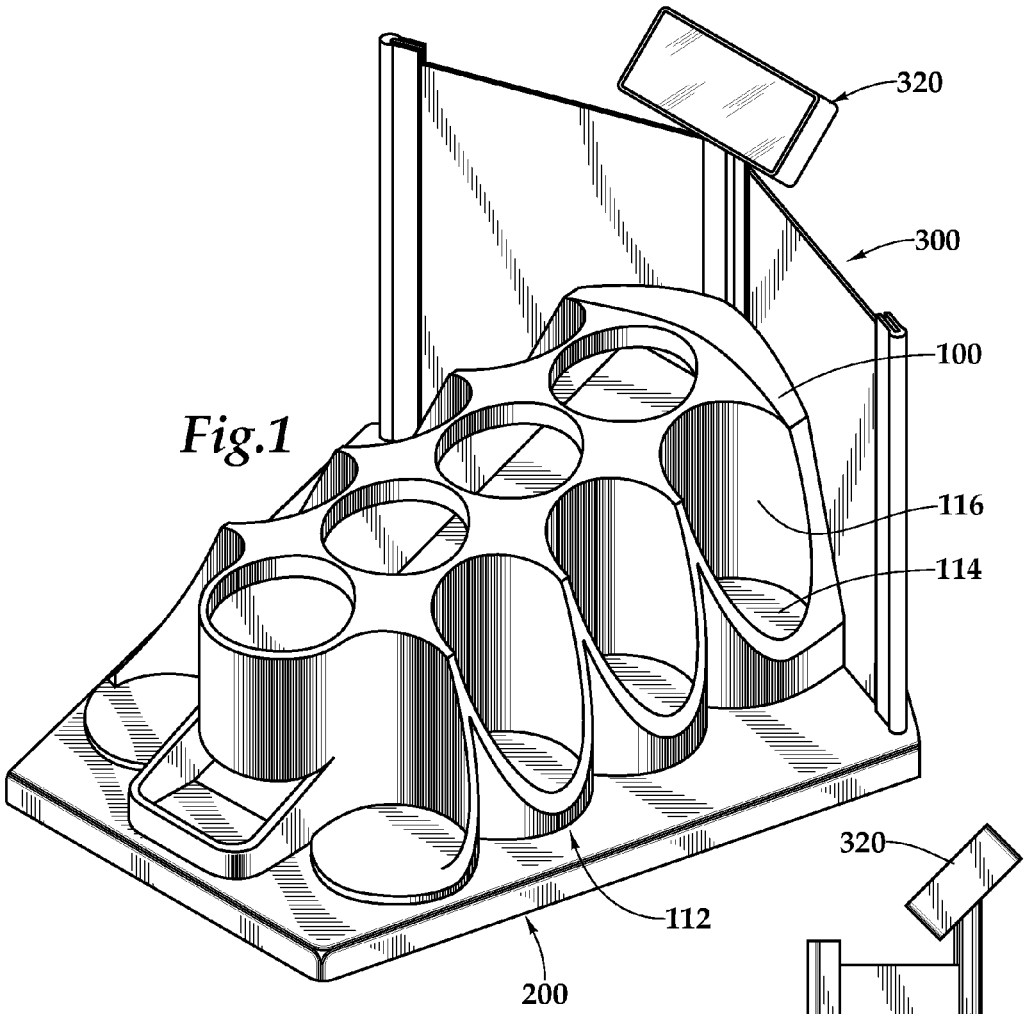
FIG. 1 is a perspective view of a game apparatus.
Figure 4:
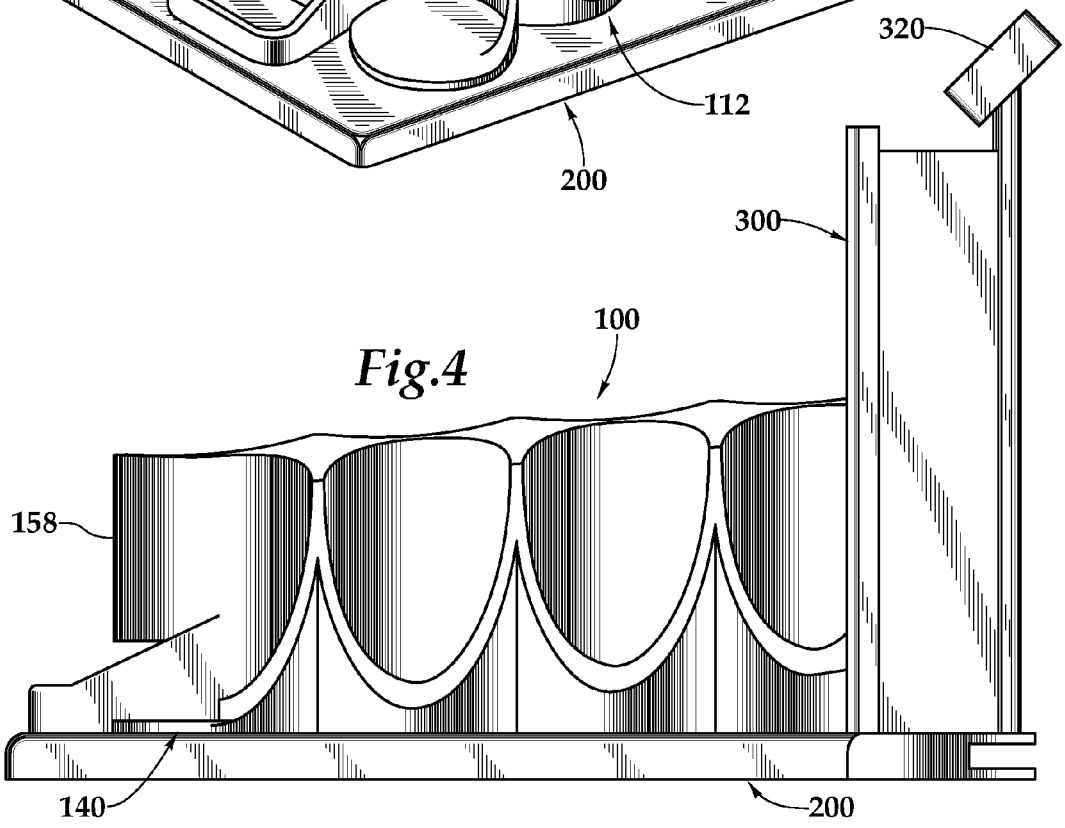
FIG. 4 is a side view of the game apparatus shown in FIG. 1, the other side being a mirror image thereof.
Figure 2:
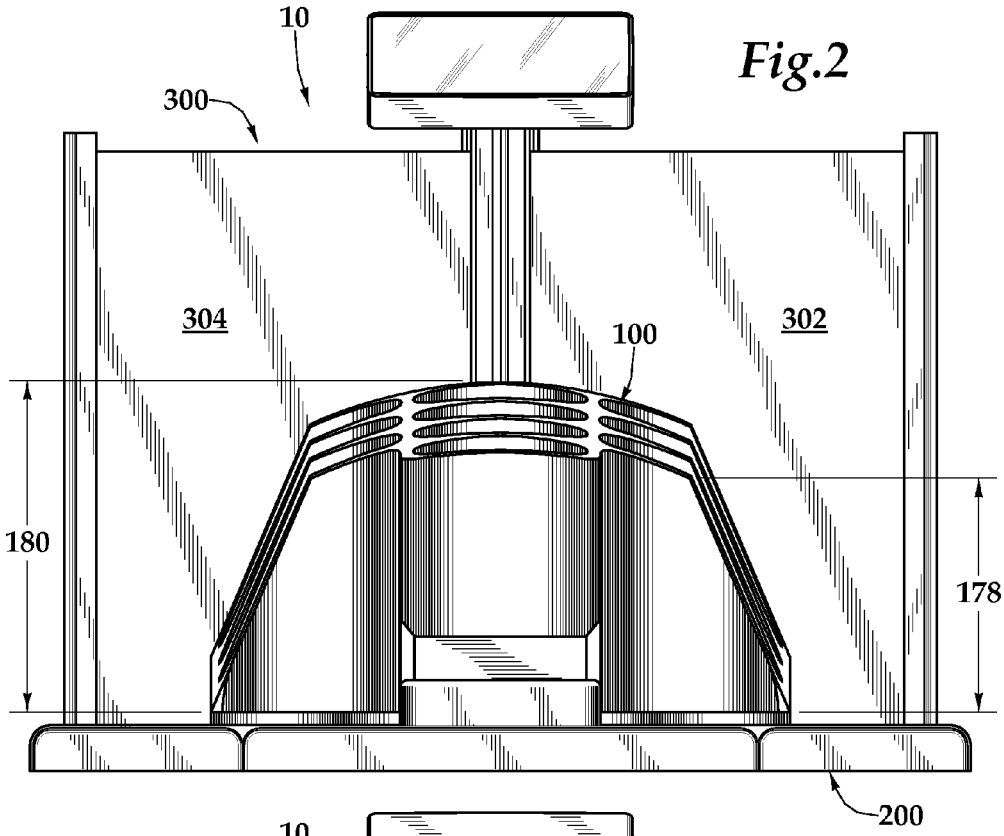
FIG. 2 is a front view of the game apparatus shown in FIG. 1.
Figure 3:
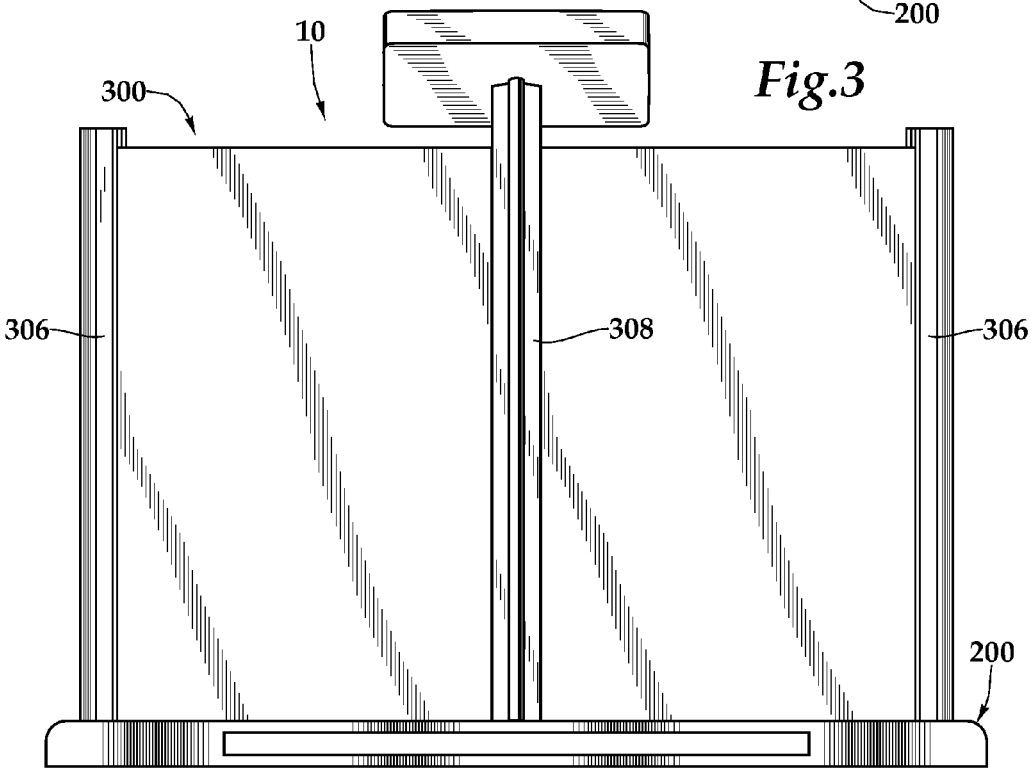
FIG. 3 is a rear view of the game apparatus shown in FIG. 1.

Referring to FIGS. 1-9, a game playing apparatus 10 is a baseball-themed apparatus configured to facilitate playing a baseball-themed game. However, game apparatus 10 may be an apparatus to facilitate playing a football-themed game or another sports-themed game. Apparatus 10 may include a game playing body or a body 100, a game surface or a surface 200, and a game playing backboard or a backboard 300. When playing the baseball-themed game, a player tosses a game playing member or a member 400 towards body 100 with the goal of landing game playing member 400 within body 100 to score points for his/her team.

Game Playing Receptacle

Game playing body 100 is configured to receive game playing member 400 and is configured to couple to game playing surface 200. In one embodiment, body 100 may be unitarily formed of a plastic material that is injection molded. Preferably, body 100 is fabricated of plastic having a thickness between about 1/16" and about 1/2", and more preferably between about 1/8" and about 1/3", and in one example about 1/4". In another embodiment, body 100 may be formed as portions and coupled together. Moreover, in another embodiment, body 100 may be fabricated from any suitable material. For example, body 100 may be fabricated from, but not limited to being fabricated from, metal, paper, nylon, polycarbonate, polyester, polyethylene, polypropylene, wood, laminate, glass, stainless steel, ceramics, and/or any combination thereof that facilitates the functionality of body 100. Further, body 100 may be of a chosen color to reduce and/or inhibit thermal communication. For example, body 100 may be fabricated specifically from light grey plastic rather than black plastic to reduce the retention of heat within body 100.

Body 100 may include a first column or a first portion 110, a second column or a second portion 120, a third column or a third portion 130, and/or a base portion 140. In one embodiment, second portion 120 is unitarily formed between first portion 110 and third portion 130. In another embodiment, portions 110, 120 and 130 are formed separately and coupled together such that second portion 120 is coupled between first portion 110 and third portion 130. In one embodiment, first portion 110 and second portion 120 may be aligned substantially parallel with an axis 111. Further, in one embodiment, third portion 130 may also be substantially parallel with axis 111. Specifically, in one embodiment, first portion 110 and third portion 130 are mirror images of one another along axis 111.

First portion 110 and third portion 130 may include a plurality of cup receptacles or a plurality of receptacles 112 configured to receive a plurality of cups 115 therein. Specifically, in one embodiment, first portion 110 and third portion 130 each has approximately four cup receptacles 112 extending between a front end 113 and an opposing rear end 117. Further, in one embodiment, cup receptacles 112 are colinear. In one embodiment, a thickness 119 is defined between each respective cup receptacle 112.

Each cup receptacle 112 is configured to receive a cup 115. Cups 115 may have varying size and shape, and may be fabricated from various materials. Preferably, cups 115 are similar in size and are plastic to prevent cups 115 from breaking while apparatus 10 is in use. In another embodiment, cups 115 are of varying height.

Each cup receptacle 112 may include a base 114 and a sidewall 116 extending upward therefrom. In one embodiment, each base 114 has a substantially round shape with a diameter 118 and a thickness 121. In another embodiment, base 114 may have any suitable shape. Further, in one embodiment, each base 114 may include an opening (not shown) defined therein to expel or channel moisture that may accumulate on base 114 from each cup 115.

In one embodiment, each sidewall 116 may be substantially cylindrically or arcuately shaped with a diameter 122 that is approximately the same as diameter 118 such that each sidewall 116 is configured to at least partially retain and/or contact a cup 115. Further, in one embodiment, each sidewall 116 has a height 124 extending between a first end 126 and an opposing second end 128 with a substantially constant thickness between ends 126 and 128. In a further embodiment, each sidewall 116 may be tapered between first end 126 and second end 128 such that a diameter (not shown) of end 126 is larger than diameter 118 of end 128. Tapered sidewalls 116 may facilitate increased ability to retain cups 115.

Additionally, in one embodiment, each sidewall 116 may include an opening or cutout portion 134 defined therein. Cutout portion 134 may have any size and be sized to facilitate easy insertion or removal of cups 115 with respective receptacles 112. In one embodiment, cutout portion 134 has a substantially arcuate shape, specifically U-shaped, extending between a first end 136 and a second end 138. In one embodiment, cutout portion 134 may have an angled or tapered surface 141. Cutout portion 134 may further be fabricated with a lip or flange (not shown) extending therefrom to facilitate retaining cup 115 therein. Moreover, cutout portion 134 is defined such that a distance 142 is defined between each base 114 and game playing surface 200. Distance 142 may vary for each cup receptacle 112. For example, distance 142 is less for a cup receptacle 112 proximate front end 113 than distance 142 for a cup receptacle 112 proximate rear end 117. Distance 142 may vary such that a cup 115 within a cup receptacle 112 proximate rear end 117 is higher than a cup 115 within a cup receptacle 112 proximate front end 113.

In one embodiment, second portion 120 is coupled between first portion 110 and third portion 130. Second portion 120 may include a top portion 150 and an opposing bottom portion 160. Specifically, in one embodiment, top portion 150 is coupled to first portion 110 and second portion 130 proximate sidewall first ends 126 of cup receptacles 112, and bottom portion 160 is coupled to first portion 110 and second portion 130 proximate sidewall second ends 128 of cup receptacles 112.

Top portion 150 may include a surface or portion 152 that extends between proximate front end 113 to proximate rear end 117 and along axis 111. In one embodiment, portion 152 is coupled between first and third portions 110 and 130 proximate each first end 126 of sidewalls 116 of cup receptacles 112. Preferably, portion 152 extends between first and third portions 110 and 130 to prevent game playing member 400 from falling into a crevice of apparatus 10 while the game is being played. In one embodiment, surface 152 is substantially planar. In another embodiment, portion 152 may include rivets and/or curves formed within portion 152 to increase the difficulty of the game such that the rivets and/or curves are designed to deflect game playing member 400 from apparatus 10.

A plurality of openings 154 may be formed within 152. Openings 154 are at graduated heights between front end 113 and rear end 117. Particularly, openings 154 ascend between front end 113 and rear end 117. For example, approximately four openings 154 may be formed within portion 152 to correspond to the number of cup receptacles 112 within first and third portions 110 and 130. Further, openings 154 are formed substantially parallel to axis 111.

Moreover, openings 154 may be labeled or include indicia that progressively read single, double, triple, and/or home run. Preferably, opening 154 closest to front end 113 would be labeled single, and opening 154 closest to rear end 117 would be labeled home run. Plurality of openings 154 may have a diameter 156. In one embodiment, diameter 156 is sized to be substantially the same size as diameter 118 of base 114. However, diameter 156 may be any size that facilitates operation of apparatus 10. Moreover, top portion 150 may include an overhang portion 158 proximate front end 113 that extends a distance 161 from substantially planar portion 152.

Furthermore, openings 154 may have any shape. Additionally, as shown in FIG. 1, the distance between each opening 154 may be substantially the same. In another embodiment, the distance between openings 154 may not be the same, which may increase the difficulty of the game.

Figure 5:
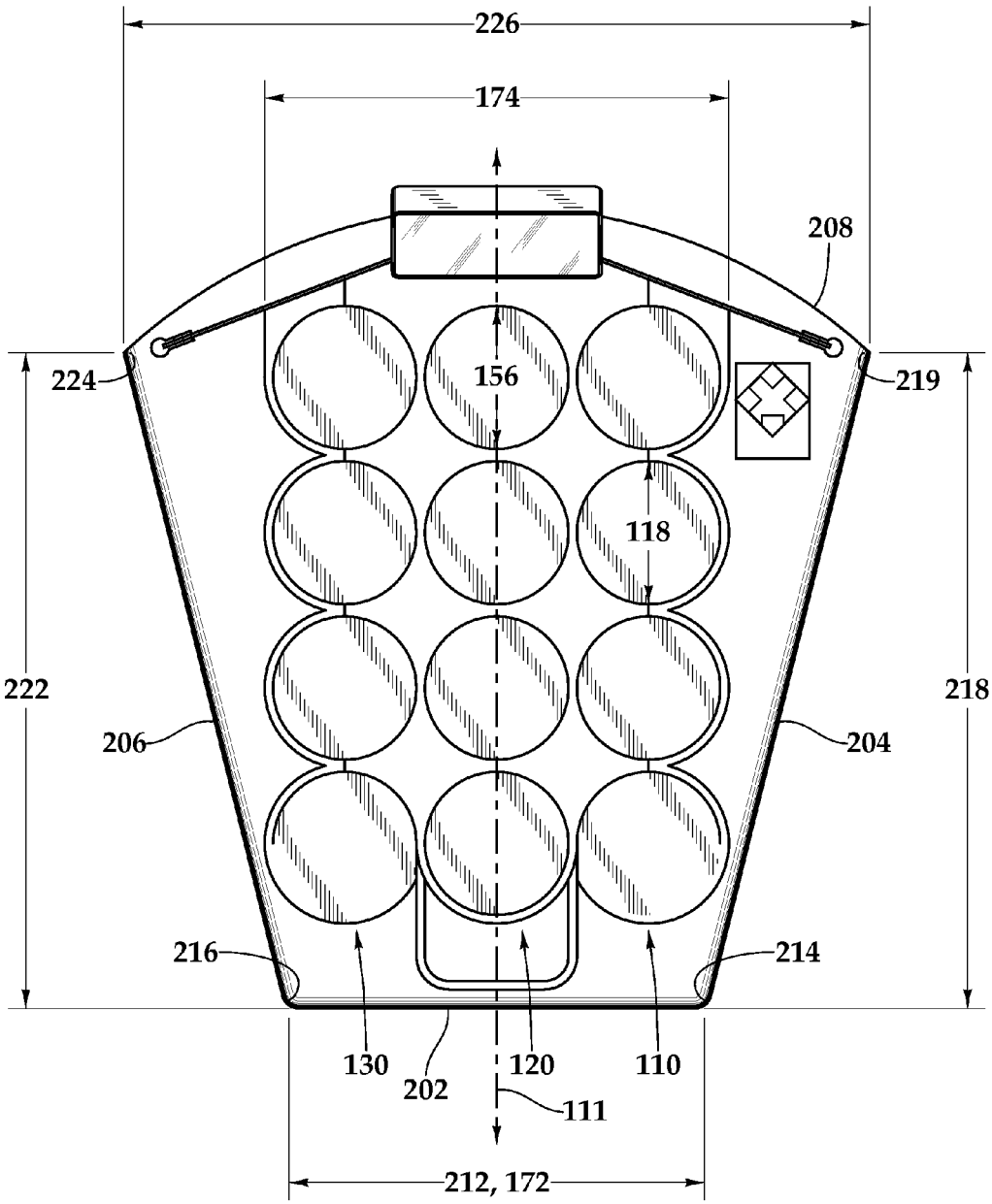
FIG. 5 is a top view of the game apparatus shown in FIG. 1.
Figure 6:
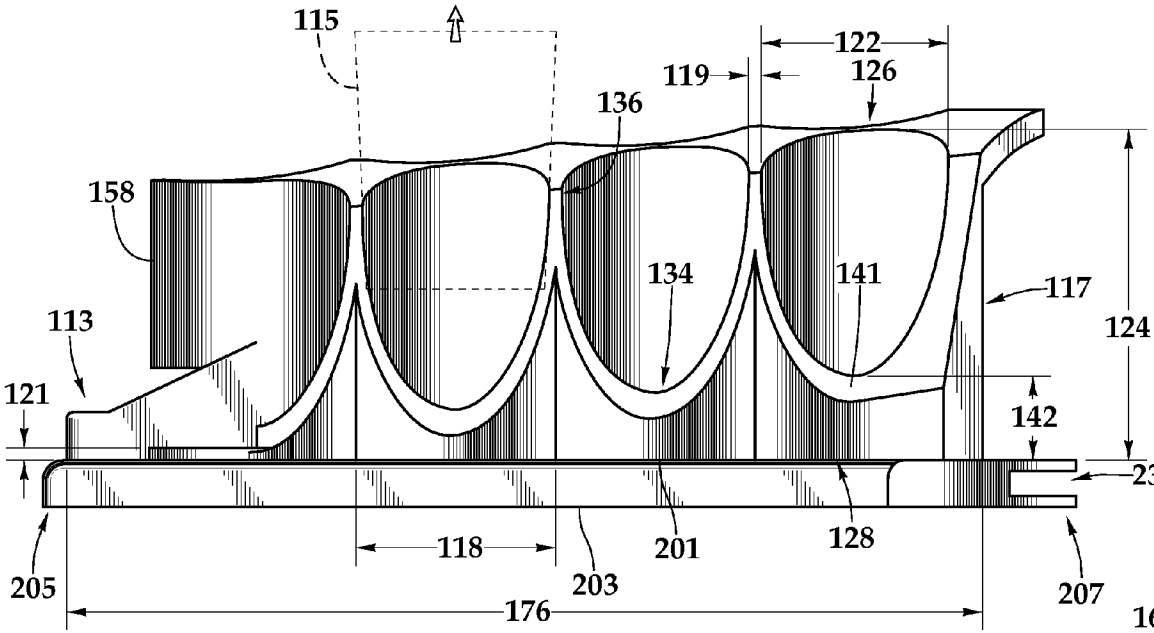
FIG. 6 is a side view of the game apparatus shown in FIG. 1, without a backboard.
Figure 7:
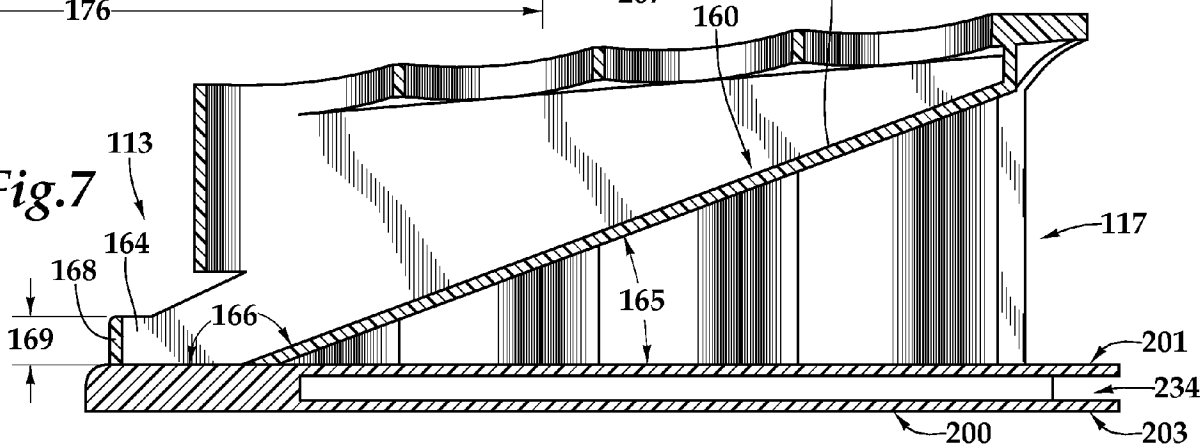
FIG. 7 is a cross-sectional view of the game apparatus shown in FIG. 1, without a backboard.
Figure 8:
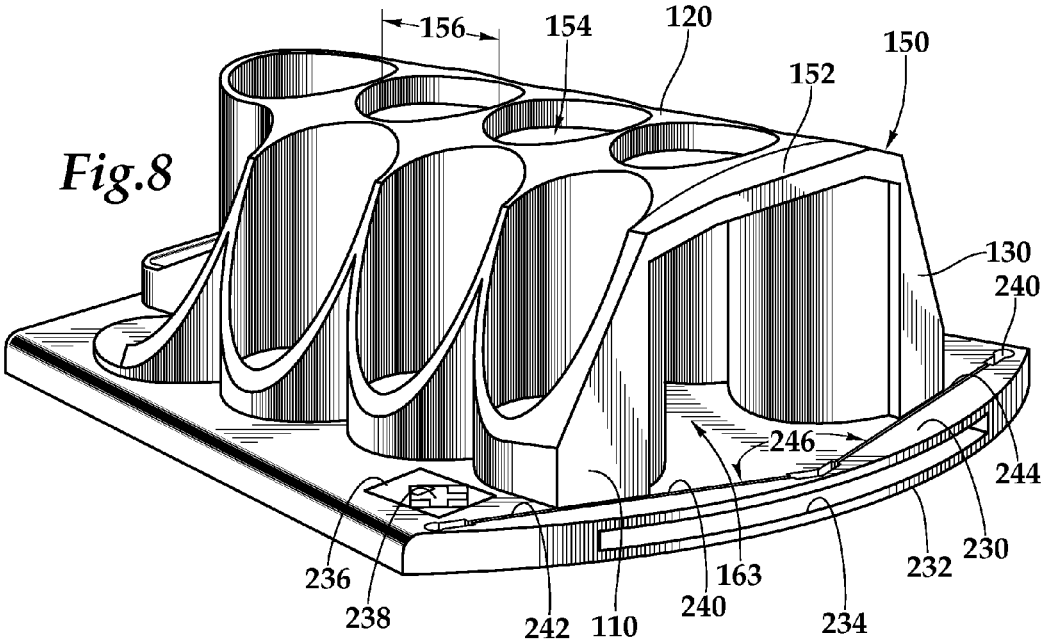
FIG. 8 is a perspective rear view of the game apparatus shown in FIG. 1, without a backboard.
Figure 9:
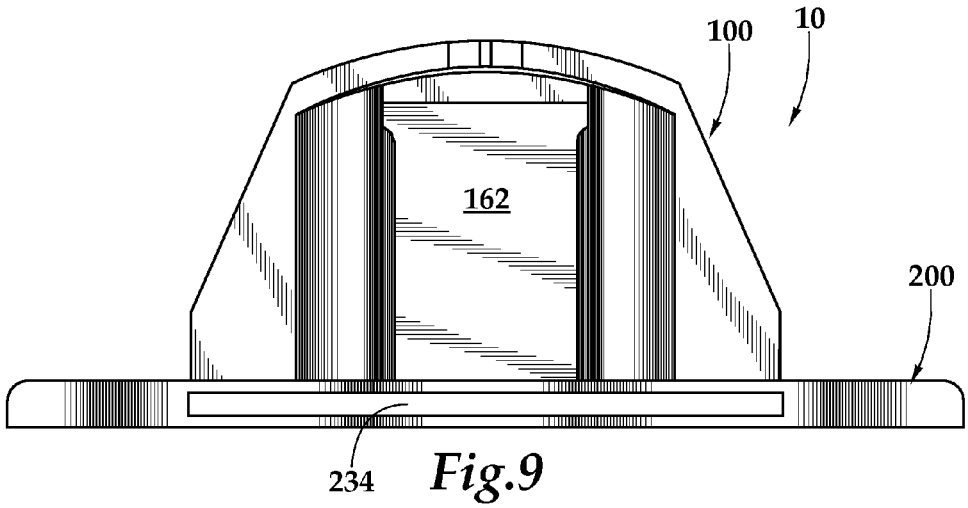
FIG. 9 is a rear view of the game apparatus in FIG. 1, without a backboard.

As shown in FIG. 5, openings 154 of second column 120 and cup receptacles 112 of first and third columns 110 and 130 may form a matrix having rows and columns. Openings 154 and cup receptacles 112 form columns that are substantially parallel with respect to one another and with axis 111. Similarly, openings 154 and cup receptacles 112 also form rows that are substantially parallel with respect to one another, and the rows are substantially perpendicular to axis 111. In an alternative embodiment, openings 154 and cup receptacles 112 may have any positioning.

Bottom portion 160 may include at least one ramp or surface 162. Surface 162 facilitates returning game playing member 400 to front end 113, as will be described in more detail herein. In one embodiment, surface 162 extends proximate front end 113 to couple to portion 152 proximate rear end 117. Surface 162 is angled such that an angle 165 is defined between surface 162 and game playing surface 200. In one embodiment, angle 165 is an acute angle. For example, angle 165 may be between about 5 degrees and about 80 degrees, preferably between about 15 degrees and about 50 degrees, and in one embodiment about 21 degrees. Because surface 162 is angled, an opening 163 may be defined underneath second portion 120 of game playing body 100.

Moreover, bottom portion 160 may include an extension surface 164 that extends outward from surface 162 proximate front end 113. Specifically, surface 164 is configured to be substantially co-planar with game playing surface 200. Moreover, an angle 166 may be defined between surface 162 and surface 164 where angle 166 may be an obtuse angle. Furthermore, a flanged portion 168 may extend a distance 169 upward from the periphery of surface 164. Flanged portion 168 may also extend upward from a portion of the periphery of ramp 162 to facilitate retaining game playing member 400 within game playing body 100.

Game playing body 100 may have an arcuate shape proximate rear end 117 to facilitate engaging game playing backboard 300.

Base portion 140 of body 100 is configured to provide a substantially planar surface to engage and/or abut game playing surface 200 to facilitate stability of body 100. Base portion 140 may be coupled to at least one of bottom portion 160 and/or receptacle bases 114. Specifically, at least one tab, flange, peg, or other attachment extends outward from base portion 140, receptacle bases 114, and/or bottom portion 160. The at least one attachment is configured to engage game playing surface 200 to prevent body 100 from moving and/or shifting with respect to surface 200.

Game playing body 100 has a width 172 proximate front end 113 and a width 174 proximate rear end 117. In one embodiment, widths 172 and 174 are substantially the same. For example, widths 172 and 174 may be approximately 13". However, width 174 may be greater than width 172. Moreover, a length 176 may be defined between front end 113 and opposing rear end 117. For example, length 176 may be approximately 21". Furthermore, body 100 has a height 178 proximate front end 113 and a height 180 proximate rear end 117, wherein height 178 is preferably greater than height 180.

Game Playing Surface

Game playing surface 200 may be a substantially planar surface with the periphery defined by a plurality of edges. In one embodiment, surface 200 may be unitarily formed of a plastic material that is injection molded. In another embodiment, surface 200 may be formed as a first surface 201 and a second surface 203 that are configured to be coupled together. In another embodiment, surface 200 may be fabricated from any suitable material. For example, surface 200 may be fabricated of plastic, metal, paper, wood, laminate, glass, and/or any combination thereof.

Surface 200 may have a front end 205 and an opposing rear end 207. In one embodiment, surface 200 has four peripheral edges 202, 204, 206, and 208. Edge 202 is proximate front end 205 and is defined by a distance 212 extending between a first end 214 and an opposing second end 216. In one embodiment, distance 212 is greater than width 172. Edge 204 extends outward a distance 218 from first end 214 to an end 219 defining an angle 220 between edges 202 and 204. In one embodiment, distance 218 of edge 204 may be greater than distance 212 of edge 202. Similarly, edge 206 extends outward a distance 222 from second end 216 to an end 224 defining an angle 226 between edges 202 and 206. In one embodiment, distance 218 and distance 222 may be substantially equal. In one embodiment, edge 208 is proximate rear end 217 and is substantially arcuate extending a distance 226 between end 219 and end 224. Distance 226 may be greater than distances 212, 218, and 222. In one embodiment, each edge 202, 204, 206, and 208 is a bowed or a curved edge. In another embodiment, distances 212, 218, 222, and 226 may change to change the size of surface 200. For example, distance 212 may be approximately 13" and distances 218 and 222 may be approximately 23".

Moreover, surface 200 may have a thickness 210 defined between an upper surface 230 and a lower surface 232. Upper surface 230 and lower surface 232 may be fabricated such that an opening 234 is defined between surfaces 230 and 232 proximate rear end 207. In one embodiment, upper surface 230 and lower surface 232 are formed unitarily. In another embodiment, surfaces 230 and 232 are formed separately and subsequently coupled together.

Game playing surface 200 may have any suitable color. For example, surface 200 may be fabricated of a green color such that surface 200 resembles grass on a baseball field. In one embodiment, a bases member 236 is coupled to surface 200, particularly to surface 230, to keep track of the base position of each player, the outs, the runs, etc., similar to a baseball game to facilitate playing of the game. Bases member 236 may be positioned within surface 230 such that member 236 is substantially flush with surface 230. Bases member 236 may be fabricated of a white-board material that easily enables players to draw on member 236 and easily erase and/or clean the member 236. Alternatively, bases member 236 may be fabricated from any material. Preferably, it is fabricated from a material that can be written on. For example, bases member 236 may be fabricated from paper or chalk board or dry erase board. Moreover, bases member 236 may include a baseball diamond 238 drawn on member 236. In a further alternative embodiment, bases member 236 may be an electronic member that enables member 236 to automatically keep track of what base each team member or game player is on.

Surface 200 may also include at least one opening (not shown) defined within upper surface 230 configured to receive the attachment to prevent movement of body 100 with respect to surface 200 and to facilitate proper placement of body 100 with respect to surface 200. In one embodiment, receptacle front end 113 is positioned proximate surface front end 205, and body 100 is substantially centered between ends 214 and 216 of edge 202.

Surface 200 may further include at least one opening (not shown) configured to receive a mechanism that lights up. For example, a post may be inserted into such an opening wherein the post has a light at one end for shining light onto apparatus 10.

Furthermore, in one embodiment, game playing surface 200 may be configured to fold to facilitate ease of transport and/or storage. Specifically, game playing surface 200 may fold along a perforated or hinged fold (not shown) along axis 111. The hinged fold may be such that at least one hinge is coupled to a portion of lower surface 232 to facilitate folding surface 200. In another embodiment, game playing surface 200 may be formed as two separate portions that may separate along the perforated or hinged fold.

Moreover, game playing surface 200 may include at least one handle (not shown) coupled thereto to facilitate transporting and/or carrying apparatus 10 and/or surface 200.

To prevent apparatus 10 from moving on the surface in which it is placed, surface 200 may include at least one grip, pad, or other mechanism on lower surface 232. Moreover, a plurality of legs (not shown) may be coupled to lower surface 232 to vary the height between the substantially horizontal surface in which the game is placed upon and game playing surface 200.

Game Playing Backboard

Game playing surface 200 may include at least one opening or slot 240 defined therein to facilitate retaining backboard 300. Slot 240 may be defined proximate rear end 207 such that when backboard 300 is inserted at least partially within slot 240, backboard 300 is adjacent and/or abuts at least a portion of body 100. In one embodiment, slot 240 may be defined by a first portion 242 and a second portion 244 with an angle 246 formed therebetween. In another embodiment, slot 240 may be curved or may be straight. Backboard 300 may have a shape that is similar to the shape of slot 240 such that backboard 300 may be inserted into slot 240. For example, if slot 240 is curved, backboard 300 is also curved.

Moreover, in one embodiment, slot 240 may have a thickness that varies. For example, one end of slot 240 may be thicker than another end of slot 240. Slot 240 is configured to retain backboard 300 substantially perpendicular to at least one of surface 200 and/or upper surface 230 such that backboard 300 facilitates retaining game playing member 400 on, near, and/or within apparatus 10 when the game is being played.

In one embodiment, backboard 300 may be formed of a paperboard material. In another embodiment, backboard 300 may be fabricated from any suitable material. For example, backboard 300 may be fabricated of metal, plastic, wood, laminate, glass, mesh, cloth, netting, and/or any combination thereof. Moreover, backboard 300 has a height 301 and a width (not shown), before backboard 300 is coupled to surface 200. Preferably, height 301 is greater than heights 178 and 180 of body 100, and the backboard width is greater than widths 172 and 174.

Moreover, in one embodiment, backboard 300 may be unitarily formed of a paperboard material with a fold or a hinge line. The fold line defines a first portion 302 and a second portion 304. In another embodiment, first portion 302 and second portion 304 may be fabricated separately and coupled together to form backboard 300.

At least one guard or support or post 306 may be coupled to at least one edge of backboard 300 to facilitate protecting the edges of backboard 300. Moreover, at least one additional guard 308 may be coupled to backboard 300 to facilitate holding backboard erect and substantially perpendicular to surface 200. Preferably, at least one guard 308 may be coupled to backboard 300. In one embodiment, guards 306 and 308 are yellow in color and resemble foul posts and/or centerfield posts.

Backboard 300 may include an image (not shown) printed or affixed thereon. The image may be an image of a back wall and stadium crowd from a baseball game to enhance the appearance of the game.

Moreover, backboard 300 may include openings therein to retain attachments. For example, backboard 300 may include an opening (not shown) defined therein to retain a cup that may be labeled "grand slam".

At least one scoring member 320 is configured to couple to backboard 300 and is configured to keep the score of the game. Scoring member 320 may include at least one fastening mechanism or clip configured to fasten scoring member 320 to a top portion of backboard 300. Preferably, scoring member 320 is coupled to the top portion of backboard 300. In another embodiment, scoring member 320 may be coupled to guard 308. Scoring member 320 may further include a display portion 324. Display portion 324 may include a table or scoring chart 326. Table 326 may include a plurality of rows and a plurality of columns. For example, table 326 may include two rows, one each for the home team and the away team, and may include eight columns, one column for each of seven innings and one column for the total score.

Scoring member 320 may be fabricated of a white-board material that easily enables players to draw on member 320 and easily erase and/or clean the member 320. Alternatively, member 320 may be fabricated from any material that can be written on. For example, member 320 may be fabricated from paper, dry erase board, and/or chalk board. In another embodiment, member 320 may include a sliding mechanism, flip cards, magnets, and/or push buttons that enable a player to slide and/or move the same along and/or on member 320 to keep track of the score. In a further embodiment, display portion 324 of member 320 may include an electronic display portion 324 and may digitally display the scores for each team. In another embodiment, member 320 may be an electronic member that enables member 320 to automatically keep track of the score. When scoring member 320 includes electronic display portion 324 and/or member 320 is an electronic member, a power source (not shown) would be configured to power member 320. Backboard 300 may also include further attachments in addition to scoring member 320 that may facilitate game play.

Whether backboard 300 is a unitary member or includes more than one portion, backboard 300 is configured to fold. Once backboard 300 is folded, it may be inserted into opening 234 proximate rear end 207. Guards 306 and/or 308 may also be inserted and stored within opening 234. Moreover, scoring member 320 and/or other attachments may be inserted and stored within opening 163 defined beneath second portion 120 of body 100.

Game Playing Member

Game playing member 400 may be any member that can be tossed towards apparatus 10 and is preferably smaller than diameter 156 of each opening 154 such that game playing member 400 may be tossed into apparatus 10 through openings 154. Game playing member 400 is preferably a member that can tossed towards a surface and bounce towards apparatus 10. For example, game playing member 400 may be a metal slug such as a quarter. In one embodiment, game playing member 400 may be, but is not limited to being, other coin such as pennies or dimes, dice, a member fabricated from plastic, a member fabricated from wood, a member fabricated from paper, and/or any combination thereof.

Method of Use

Game playing apparatus 10 is a baseball-themed apparatus configured to facilitate playing a baseball-themed game. The baseball-themed game is played with at least two players or batters, a consumable liquid and/or food and/or a door prize (i.e., object), a plurality of cups 115, and a plurality of game playing members 400. To prepare to play the game, divide the at least two players into two teams and organize a batting order within each team. Determine which team is the visiting team, which will bat or play first, and the remaining team is the home team, which will bat or play second. Apparatus 10 should be placed on any table, countertop, or a substantially horizontal surface. Preferably, apparatus 10 is positioned approximately one foot from the edge of the table or countertop. In one embodiment, apparatus 10 is positioned on the floor. Also, in one embodiment, apparatus 10 is elevated and/or adjusted by a plurality of legs coupled to surface 232.

Once apparatus 10 is in position, at least one cup 115 is placed within each cup receptacle 112 within each portion 110 and 130. In another embodiment, at least one cup 115 may be placed within select cup receptacles 112 within portions 110 and 130. In one embodiment, cups 115 placed within portion 110 are considered the home team's cups and cups 115 placed within portion 130 are considered the visiting team's cups. Cups 115 within apparatus 10 are then filled with the chosen consumable liquid or food or door prize. Cups 115 may be labeled to prevent confusion between teams. Moreover, different color cups may be used to prevent confusion. Also, cups 115 may be of varying sizes depending on multiple factors such as the size of apparatus 10, the size of cup receptacles 112, and the liquid or food or door prize being used to play the game.

To begin playing the game, a first player on the visiting team stand near the edge of the table and/or counter and tosses game playing member 400 towards the table and/or counter in an attempt to bounce game playing member 400 on the table and/or counter such that member 400 projects towards apparatus 10. In another embodiment, member 400 is tossed directly towards apparatus 10, without bouncing member 400.

The goal of bouncing member 400 on the table and/or counter is to land member 400 within at least one opening 154 within second portion 120 wherein each opening 154 may be labeled with at least one of single, double, triple, and home run. If the player bounces member 400 into one of openings 154, member 400 will slide down surface 162 of bottom portion 160 towards front end 113 where substantially planar surface 164 and flanged portion 168 will retain game playing member 400. Moreover, if the player bounces member 400 into one of openings 154, the opposing team must consume the liquid and/or food and/or remove the door prize within the cup 115 (labeled for their team) that is in the cup receptacle 112 that is beside the opening 154 that member 400 landed within. Moreover, the opposing team must consume the liquid and/or food and/or remove the door prize within the cups 115 that are positioned between front end 113 and the cup 115 next to the opening 154 that member 400 landed within. For example, if a home team player bounces member 400 into opening 154 labeled "triple", then the visiting team is to consume the food and/or liquid and/or remove the door prize within the visiting team's cup 115 next to the opening labeled "single", the visiting team's cup 115 next to the opening labeled "double", and the visiting team's cup 115 next to the opening labeled "triple". Moreover, if the player gets a "triple", then it is recorded. However, if each team only has one player, the player only consumes the liquid and/or food and/or removes the door prize within the cup 115 that is positioned next to the opening 154 that member 400 landed within. Similarly, if the player bounces member 400 into the "grand slam" cup coupled to backboard 300, then the opposing team must consume all cups 115 for both the visiting and the home team.

On the other hand, if the player does not bounce member 400 into one of the openings 154, an out is recorded. If the player tosses member 400 into one of the cups 115, an out is recorded and the batting team (or the team in which the most recent player that just tossed member 400 towards apparatus 10) must drink and/or eat the liquid and/or food and/or remove the door prize within the cup 15 that member 400 landed in. Once that cup 15 is emptied of the liquid and/or food and/or door prize, cup 15 is refilled and repositioned within cup receptacle 112.

While the game is being played, the score, the runs, and the outs are all tallied and kept track of on at least one of the scoring member 320 and/or the bases member 236. If one team gets three outs, the teams switch. In other words, the players from the other team are to toss member 400 or are "up to bat". Once each team has batted, the next inning begins. The team with the most runs recorded after a predetermined number of innings, e.g., after seven innings, wins the game. If there is a tie, the players choose how to settle the game. For example, additional innings may be played. In another embodiment, the game is won when a predetermined event occurs.

The apparatus of the present invention provides a game playing apparatus that is easy to use, that is cost-effective, and has increased functionality. Specifically, the present invention provides an apparatus to facilitate the playing of a baseball themed game. Moreover, the present invention provides a game apparatus that may be used with other similar games including, but not limited to, other sports games such as football.

While the foregoing written description of the invention enables one of ordinary skill to make and use what is considered presently to be the best mode thereof, those of ordinary skill will understand and appreciate the existence of variations, combinations, and equivalents of the specific exemplary embodiment and method herein. The invention should therefore not be limited by the above described embodiment and method, but by all embodiments and methods within the scope and spirit of the invention as claimed.

What is claimed is:

1. A game playing apparatus configured to facilitate playing a game, said game playing apparatus comprising:

a body comprising:

at least one first column comprising at least one receptacle, and at least one second column coupled to said at least one first column, said second column having an upper surface having a plurality of openings such that a member may be tossed into at least one of said openings;

wherein said body has a front end and an opposing rear end, said openings are at graduated heights between said front end and said rear end such that said openings ascend from said front end to said rear end; and a game surface coupled to said body; and a backboard coupled substantially perpendicular to said game surface.

2. An apparatus according to claim 1 wherein said first column and said second column are substantially parallel.

3. An apparatus according to claim 1 wherein said first column comprises at least four receptacles, each of said at least four receptacles is configured to receive a cup therein, each of said at least four receptacles comprises at least one base and at least one sidewall extending therefrom.

4. An apparatus according to claim 3 wherein said cup is a plastic cup.

5. An apparatus according to claim 1 wherein said upper surface of said second column is substantially planar.

6. An apparatus according to claim 1 wherein said body is fabricated of a plastic material.

7. An apparatus according to claim 1 wherein said backboard is fabricated from a cardboard material, said backboard comprising at least one post coupled thereto.

8. An apparatus according to claim 7 wherein said backboard further comprises a first portion and a second portion, an angle is defined between said first portion and said second portion.

9. An apparatus according to claim 1 wherein said game surface comprises at least one opening formed therein configured to receive said backboard.

10. An apparatus according to claim 1 wherein said backboard comprises at least one scoring member coupled thereto, said at least one scoring member configured to keep the score of the game.

11. An apparatus according to claim 1 wherein said member is at least one of a die, a ball, and a coin.

12. An apparatus according to claim 1 wherein said upper surface has indicia proximate each of said openings.

13. An apparatus according to claim 1 wherein said first column and said second column are unitarily fabricated.

14. A game playing apparatus configured to facilitate playing a game, said game playing apparatus comprising:

a body comprising:

at least one first column comprising at least one receptacle, and at least one second column coupled to said at least one first column, said second column having an upper surface having a plurality of openings such that a member may be tossed into at least one of said openings;

wherein said second column further comprises at least one ramp, wherein an acute angle is defined between said ramp and a substantially horizontal surface; and a game surface coupled to said body; and a backboard coupled substantially perpendicular to said game surface.

15. A game playing apparatus configured to facilitate playing a game, said game playing apparatus comprising:

a body comprising:

at least one first column comprising at least one receptacle, and at least one second column coupled to said at least one first column, said second column having an upper surface having a plurality of openings such that a member may be tossed into at least one of said openings; and a game surface coupled to said body, wherein said game surface comprises a bases member configured to keep track of a base position of a player; and a backboard coupled substantially perpendicular to said game surface.

16. A game playing apparatus configured to facilitate playing a game, said game playing apparatus comprising:

a body comprising:

at least one first column comprising at least one receptacle, and at least one second column formed integrally with said at least one first column, said second column having an upper surface having a plurality of openings such that a member may be tossed into at least one of said openings;

wherein said body has a front end and an opposing rear end, said openings are at graduated heights between said front end and said rear end such that said openings ascend from said front end to said rear end; and a game surface coupled to said body; and a backboard coupled substantially perpendicular to said game surface.

17. A game playing apparatus configured to facilitate playing a game, said game playing apparatus comprising:

a body comprising:

at least one first column comprising at least one receptacle, and at least one second column formed integrally with said at least one first column, said second column having an upper surface having a plurality of openings such that a member may be tossed into at least one of said openings;

wherein said second column further comprises at least one ramp, wherein an acute angle is defined between said ramp and a substantially horizontal surface; and a game surface coupled to said body; and a backboard coupled substantially perpendicular to said game surface.

* * * * *